US007739993B2

(12) United States Patent
Salzgeber et al.

(10) Patent No.: US 7,739,993 B2
(45) Date of Patent: Jun. 22, 2010

(54) INTERNAL COMBUSTION ENGINE

(75) Inventors: Kurt Salzgeber, Graz (AT); Wolfgang Kling, Graz (AT)

(73) Assignee: AVL List GmbH, Graz (AT)

( * ) Notice: Subject to any disclaimer, the term of this patent is extended or adjusted under 35 U.S.C. 154(b) by 191 days.

(21) Appl. No.: 12/073,852

(22) Filed: Mar. 11, 2008

(65) Prior Publication Data

US 2008/0210204 A1 Sep. 4, 2008

Related U.S. Application Data

(62) Division of application No. 10/563,823, filed as application No. PCT/AT2004/000220 on Jun. 24, 2004, now Pat. No. 7,428,889.

(30) Foreign Application Priority Data

Jul. 8, 2003 (AT) ..... GM485/2003
Jun. 3, 2004 (AT) ..... A 963/2004

(51) Int. Cl.
*F02B 53/00* (2006.01)

(52) U.S. Cl. ..... 123/193.2; 123/53.6

(58) Field of Classification Search ..... 123/52.2, 123/53.6, 193.2, 193.3
See application file for complete search history.

(56) References Cited

U.S. PATENT DOCUMENTS

| | | | | |
|---|---|---|---|---|
| 1,895,206 | A * | 1/1933 | Ricardo | 123/51 B |
| 2,452,238 | A * | 10/1948 | Hollingsworth | 123/48 R |
| 3,476,099 | A * | 11/1969 | Packard et al. | 123/193.1 |
| 3,489,130 | A * | 1/1970 | Polidan et al. | 123/193.4 |
| 6,164,260 | A * | 12/2000 | Bock | 123/193.2 |
| 6,619,244 | B1 * | 9/2003 | Ho | 123/56.1 |
| 2004/0221823 | A1 * | 11/2004 | Warren | 123/45 R |

* cited by examiner

*Primary Examiner*—M. McMahon
(74) *Attorney, Agent, or Firm*—Dykema Gossett PLLC

(57) ABSTRACT

A piston of an internal combustion engine includes a cavity for gases passing a piston ring and a first flow path leading from the cavity to a piston ring region and a second flow path extending from the cavity to an outlet opening for removing gases to an inlet opening in a cylinder wall in at least one piston position.

11 Claims, 2 Drawing Sheets

INTERNAL COMBUSTION ENGINE

This application is a division of application Ser. No. 10/563,823, filed Feb. 27, 2006 (now U.S. Pat. No. 7,428,889), which was a U.S. national phase of PCT/AT2004/000220, filed 24 Jun. 2004. The PCT application claimed priorities of Austrian Application Nos. A 963/2004, filed Jun. 3, 2004, and GM 485/2003 U, filed Jul. 8, 2003. All priorities are requested.

The invention relates to an internal combustion engine with at least one piston reciprocating in a cylinder, comprising a piston ring region with at least one piston ring, with the piston comprising at least a first cavity for receiving gases passing at least one compression ring, with the piston ring region of the piston being connected via at least a first manifold with the first cavity, and with gases being removable via at least a second manifold from the first cavity.

A two-stroke internal combustion engine is known from U.S. Pat. No. 5,067,453 A, comprising a piston reciprocating in a cylinder, with the piston comprising a blow-by passage through which so-called blow-by gases passing the piston rings are removed into the interior of the piston. The gases can flow back from the interior of the piston via scavenging manifolds into the crank chamber when the piston is situated at the upper dead center. This should prevent that the lubricating film on the cylinder slideway is destroyed by hot combustion gases.

An internal combustion engine with a piston reciprocating in a cylinder is known from JP 2-215955 A which comprises manifolds originating from the piston ring region, which manifolds lead to a cavity formed by a hollow gudgeon pin. A further manifold originates from the cavity, which manifold leads to the piston head adjacent to the combustion chamber. The blow-by gases passing the piston rings are guided via the manifolds into the interior of the gudgeon pin and flow from the same via the further manifold to the surface of the piston and back to the combustion chamber. As a result of this measure, however, an uncontrollably high oil stream reaches the combustion chamber, leading to a substantial deterioration in the exhaust gas quality.

Opposed-piston engines with two pistons oscillating in opposite directions in a cylinder are well known, e.g. from DE 27 04 006 A1 or DE 1 942 007 A.

Opposed-piston engines come with the advantage of favorable mass balancing. Since the combustion chamber is formed between the two piston heads, it is possible to omit a cylinder head acting as a cooling surface, leading to a very favorable thermal efficiency.

There is, however, a disadvantageous influence on the combustion progress and consumption of lubricating oil by deposits on the wall, especially in the head land region of the piston.

It is the object of the present invention to avoid such disadvantages and to achieve in the simplest and most effective way a separation of the blow-by gases passing the piston rings from the oil mist in an internal combustion engine. A further object is reducing deposits and the consumption of lubricating oil.

This is achieved in accordance with the invention in such a way that the second flow path ends in an outlet opening in the region of the wall of the piston, preferably in the region of the piston skirt, with the outlet opening communicating in at least one piston position with an inlet opening in the cylinder wall, which inlet opening preferably leads to a collecting manifold in the cylinder housing. The first cavity can be formed as an annular space adjacent in a radially inward manner to the piston ring region.

The first and/or second flow path can be configured as a manifold formed into the piston. The blow-by gases flow through the first flow path which originates from the piston ring region in the region of the compression ring to the first cavity and are guided via a second manifold which is arranged inclined substantially in the direction of the crank chamber to an outlet opening in the region of the piston skirt. At a certain piston position, e.g. in the region of the lower dead center, the outlet opening communicates with a respective inlet opening in the cylinder wall of the cylinder housing, as a result of which the gases enclosed in the first cavity can flow into the collecting manifold. An oil separation system is directly connected to the collecting manifold where a substantial separation of the oil from the blow-by gas mist occurs. The lubricating oil is guided back again to the crank chamber. In order to avoid a return flow of the gases contained in the collecting container into the cylinder and to produce oil separation it is provided that a non-return valve is arranged in the region of the inlet opening, which valve opens in the direction of the collecting manifold.

In a further embodiment of the invention it can be provided that the first cavity is flow-connected via at least one connecting manifold with a second cavity formed by a hollow configured gudgeon pin. The hollow gudgeon pin is used as an additional volume for receiving the blow-by gases, as a result of which relatively large blow-by gas volumes can be collected within the piston. This has an especially advantageous effect on the separation of the blow-by gases from the crank chamber.

In a further development of the invention it is provided that the second flow path is formed by the hollow configured gudgeon pin. The outlet opening is preferably formed by an open face side of the gudgeon pin.

It is further provided within the scope of the invention that in a region associated with one of the upper dead center positions of the piston a substantially cylindrical fire ring is arranged in the cylinder. The inside diameter of the fire ring is advantageously smaller than the diameter of the cylinder. The width of the fire ring is dimensioned in such a way that the head lands of the piston immerse into the fire ring in the upper dead center, as a result of which deposits are removed or avoided.

It is preferably provided that the fire ring is inserted in an annular recess of the cylinder jacket.

In order to enable easy insertion in the cylinder preferably formed by a cylinder liner it is advantageous when the fire ring is provided with a slotted configuration. Traces of the slot on the piston by the motion of the piston over the fire ring can be prevented when the slot is provided with an inclined configuration, i.e. it is inclined to the cylinder axis.

The fire ring is preferably arranged in a locked manner in the cylinder and is preferably held by an anti-twist device. It can be provided that the anti-twist device of the fire ring is formed by a screw or pin preferably engaging in the slot and inserted into the cylinder. It is especially appropriate when the anti-twist device is inserted into the slot and the diameter of the screw fully fills the width of the slot. Any twisting of the fire ring and any inadvertent falling out can thus be avoided.

It can be provided in a further embodiment of the invention that the fire ring comprises a pass-through opening for a component opening into the combustion chamber, with the component preferably being an injection nozzle, a pre-chamber nozzle or a spark plug. Injection nozzles, pre-chamber nozzles and/or spark plugs can thus project through the fire ring into the combustion chamber defined by the fire ring.

The invention is explained below in closer detail by reference to the enclosed figures, wherein.

Figure 2:
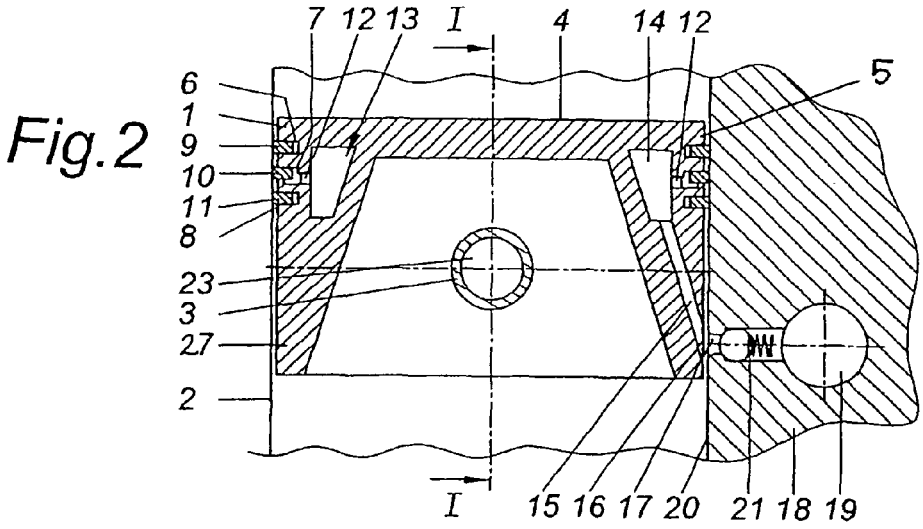
FIG. 2 shows the piston in a sectional view transversally to the gudgeon pin according to line II-II in FIG. 1.

A piston 1 is held in a cylinder 2 in a reciprocating manner and connected via a gudgeon pin 3 with a connecting rod (not shown in closer detail) for power transmission to a crankshaft. The piston 1 comprises piston ring region 5 which is adjacent to piston head 4 and comprises grooves 6, 7 and 8 for piston rings, namely compression rings 9, 10 and oil wiping ring 11. A first slow path 12 which is formed by a manifold leads from the groove 7 of the lower compression ring 10 to a first cavity 13 which is formed as an annular space 14 radially adjacent to the piston ring region 5. The annular space 14 is connected with an outlet opening 16 in the piston skirt 27 by way of at least one second flow path 15 which leads in an oblique manner in the direction of the crank chamber and is configured as a manifold (FIG. 2).

A collecting manifold 19 is formed in the cylinder housing 18, which manifold originates from an inlet opening 17 in the cylinder wall 20. The inlet opening 17 communicates in a specific position of the piston 1, e.g. in the lower dead center, with the outlet opening 16 in the piston skirt 27. A non-return valve 21 is arranged in the flow transfer between the inlet opening 17 and the collecting manifold 19, which valve opens in the direction of the collecting manifold 19 and which prevents a return flow of gases from the collecting manifold 19 to the cylinder 2. The collecting manifold 19 is in connection with a crank chamber venting line or directly with an inlet flow path of the internal combustion engine.

Blow-by gases which pass the compression rings 9, 10 reach the first cavity 13 via the first manifolds 12 and are held back in this annular space 14 until the outlet opening 16 is situated at the same level as the inlet opening 17. When the inlet opening 17 corresponds to the outlet opening 16, the gases held back in the annular space 14 can be conveyed via the non-return valve 21 to the collecting space 19 and further to an inlet flow path (not shown in closer detail).

Figure 1:
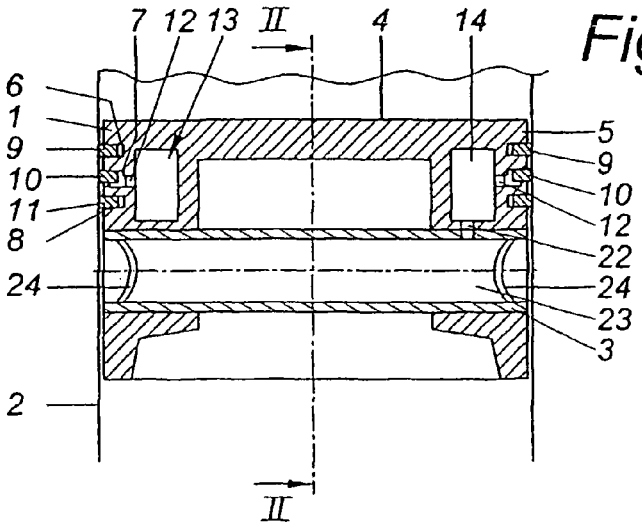
FIG. 1 shows a piston of an internal combustion engine in accordance with the invention in a longitudinal sectional view relative to the gudgeon pin according to line I-I in an embodiment in FIG. 2.

In addition to the first cavity 13, a second cavity formed by the hollow gudgeon pin 3 can be used as an additional volume in which the annular space 14 is flow-connected via at least one connecting manifold 22 with the second cavity 23 in the interior of the gudgeon pin 3. The gudgeon pin 3 is sealed in a gas-tight manner on the face side by a cover 24 (FIG. 1). The blow-by gases are intermediately stored in the first and second cavity 13, 23.

Figure 3:
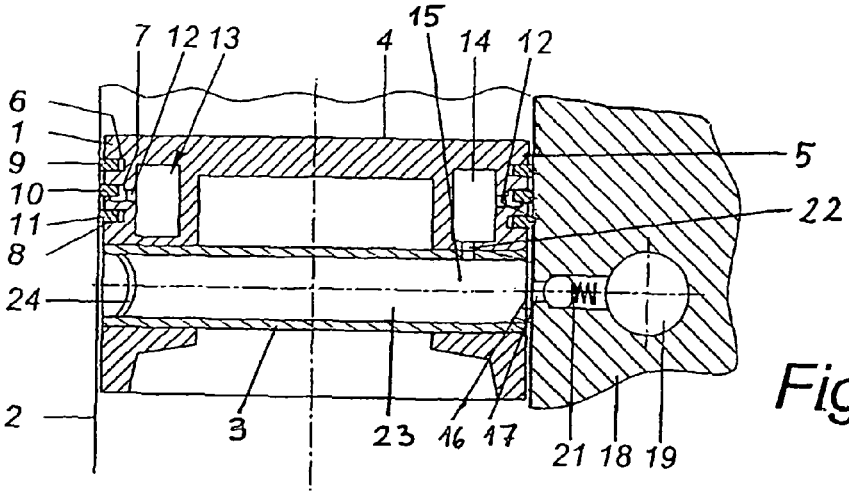
FIG. 3 shows the piston in a further embodiment.

It is further also possible to configure the gudgeon pin 3 on at least one face side without a cover, as a result of which the gudgeon pin 3 forms itself the outlet opening 16 of the second flow path 15. The second flow path 15 is formed in this case by the interior of the gudgeon pin 3. The inlet opening 17 is arranged in a region of the cylinder wall 2 in such a way that the outlet opening 16 communicates with the inlet opening 17 at least in one piston stroke position in order to enable a discharge of the blow-by gases into the collecting space (FIG. 3).

The intermediate storage of the blow-by gases in the annular space 14 and the removal of the blow-by gases via the second manifold 15 to the collecting manifold 19 ensures an especially favorable separation of the blow-by gases from the crank chamber. As a result, the intensity of the mixture of the oil pollutants contained in the blow-by gases with the lubricating oil can be strongly reduced and thus the oil ageing behavior can be improved substantially.

Figure 4:
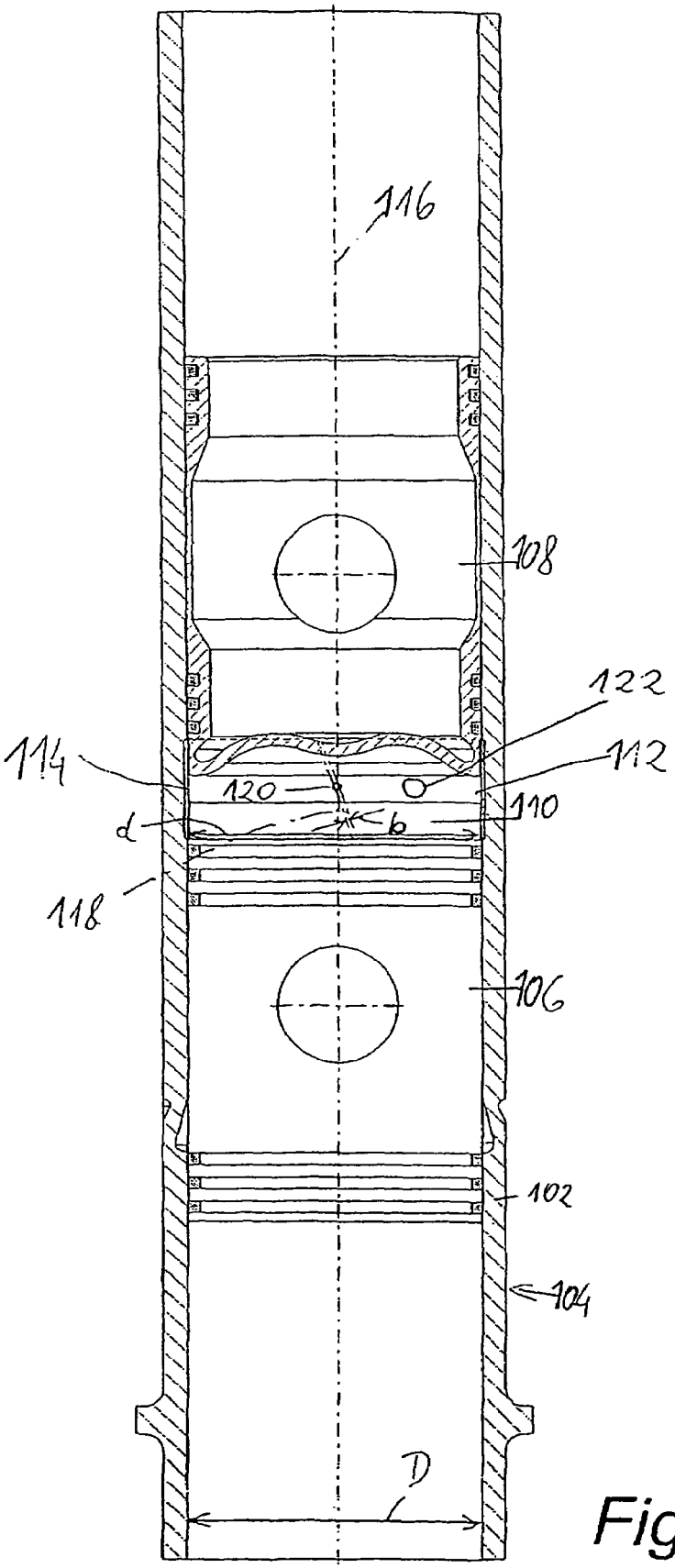
FIG. 4 shows a cylinder of the internal combustion engine according to a configuration of the invention in a longitudinal sectional view.

FIG. 4 shows a cylinder of an internal combustion engine in a longitudinal sectional view. Two pistons 106 synchronously oscillating in opposite directions are arranged in a cylinder 104 formed by a cylinder liner 102 of an opposed-piston engine. The pistons 106, 108 are in connection via a connecting rod (not shown in closer detail) with a crank mechanism each (not shown in closer detail), with the crank mechanisms being synchronized with each other. The figure shows the two pistons 106, 108 in the upper dead center position in which the pistons 106, 108 are subjected to the closest approach. A fire ring is arranged in the region of the intermediate space defining a combustion chamber 110 between the two pistons 106, 108, with the fire ring 112 being inserted into an annular recess 114 of the cylinder liner 102, which recess is preferably formed by a relief. The inner diameter d of the fire ring 112 is smaller than the diameter D of the cylinder 104.

The fire ring 112 comprises a slot 118 which is configured in an inclined manner relative to the cylinder axis 116 and by which the diameter of the fire ring 112 can be reduced in a slightly elastic manner during the mounting in order to enable the insertion into the cylinder liner 102 until the fire ring 112 latches into the recess 114.

Because the slot 118 is configured to be inclined relative to the cylinder axis 116, traces of the slot 118 caused by the motion of the piston 106, 108 are prevented.

In order to prevent any twisting of the fire ring 112, the same is arranged in an anti-twist manner in the cylinder liner 102. The anti-twist device can be formed by a screw 120 which engages in the slot 118, is joined to the cylinder liner 102 and whose diameter fully fills the width b of the slot 118. This prevents the twisting of the fire ring 112 and any inadvertent reduction in the inside diameter of the fire ring 112 and thus the inadvertent falling out from cylinder liner 102.

The fire ring can comprise at least one radial recess 122 for an injection nozzle, a pre-chamber nozzle or a spark plug.

The so-called "bore polishing" by deposits can effectively be prevented by the fire ring and a reduction and long-term stabilization of the consumption of lubricating oil can be achieved.

The claims filed with the application are proposals for formulation without any prejudice for achieving further reaching patent protection. The applicant reserves the right to claim further features previously only disclosed in the description and/or drawings.

References back used in the sub-claims refer to the further configuration of the subject matter of the main claim by the features of the respective sub-claim. They shall not be understood as a waiver to achieving an independent relevant protection for the features of the sub-claims which refer back.

The subject matters of these sub-claims also form independent inventions which have a configuration which is independent from the subject matters of the preceding sub-claims.

The invention is also not limited to the embodiment(s) of the description. Numerous alterations and modifications are possible within the scope of the invention, especially such variants, elements and combinations and/or materials which are inventive for example by combination or modification of individual features, elements or method steps described in the general description and claims or contained in the drawings and lead to a new subject matter or to new method steps or sequences of method steps by combinable features, which shall also apply insofar as they relate to manufacturing, testing and working methods.

The invention claimed is:

1. An internal combustion engine with a cylinder, in which two pistons are arranged oscillating, in opposite directions, wherein in a region associated with one of the upper dead center positions of the pistons a substantially cylindrical fire ring is arranged in the cylinder, wherein the fire ring is arranged in an anti-twisting manner in the cylinder, and wherein the fire ring is held by an anti-twist device.

2. The internal combustion engine according to claim 1, wherein the inside diameter of the fire ring is smaller than the diameter of the cylinder.

3. The internal combustion engine according to claim 1, wherein the fire ring is inserted into an annular recess of the cylinder jacket of a cylinder, which recess is formed by a relief.

4. The internal combustion engine according to claim 1, wherein the fire ring is provided with a slotted configuration.

5. The internal combustion engine according to claim 4, wherein a slot of the fire ring is configured in an oblique manner relative to a cylinder axis.

6. The internal combustion engine according to claim 1, wherein the anti-twist device of the fire ring is formed by a screw or pin engaging in the slot and inserted into the cylinder.

7. The internal combustion engine according to claim 1, wherein the anti-twist device fully fills the width of the slot at least one point.

8. The internal combustion engine according to claim 1, wherein the cylinder is formed by a cylinder liner.

9. The internal combustion engine according to claim 1, wherein the fire ring comprises at least one pass-through opening for a component opening into the combustion chamber, with the component being selected from the group injection nozzle, pre-chamber nozzle and spark plug.

10. An internal combustion engine with a cylinder, in which two pistons are arranged oscillating in opposite directions as claimed in claim 1, wherein in a region associated with one of the upper dead center positions of the pistons a substantially cylindrical fire ring is arranged in the cylinder, and wherein the fire ring is provided with a slotted configuration.

11. The internal combustion engine according to claim 10, wherein a slot of the fire ring is configured in an oblique manner relative to a cylinder axis.

* * * * *